US005660236A

United States Patent [19]

Sears et al.

[11] Patent Number: 5,660,236

[45] Date of Patent: Aug. 26, 1997

[54] DISCHARGING FIRE AND EXPLOSION SUPPRESSANTS

[75] Inventors: Richard F. Sears, Kenly; Terence Simpson, Wilson, both of N.C.

[73] Assignee: Kidde Technologies, Inc., Wilson, N.C.

[21] Appl. No.: 495,820

[22] Filed: Jun. 28, 1995

Related U.S. Application Data

[63] Continuation-in-part of Ser. No. 278,411, Jul. 21, 1994, abandoned.

[51] Int. Cl.[6] ..... A62C 13/22

[52] U.S. Cl. ..... 169/72; 169/84; 169/33; 169/73; 169/85

[58] Field of Search ..... 169/9, 26, 33, 169/72, 73, 74, 84, 85

[56] References Cited

U.S. PATENT DOCUMENTS

| | | | |
|---|---|---|---|
| 1,660,713 | 2/1928 | Kauch et al. | 169/73 |
| 2,346,183 | 4/1944 | Paulus et al. | 169/73 |
| 2,557,120 | 6/1951 | Knoblock | 169/73 |
| 2,557,162 | 6/1951 | Wetzel et al. | 169/73 |
| 2,767,796 | 10/1956 | Roberts | 169/73 |
| 2,804,929 | 9/1957 | Plummer | 169/9 |
| 2,808,114 | 10/1957 | Parker et al. | 169/9 |
| 2,856,010 | 10/1958 | Brill et al. | 169/9 |
| 3,401,750 | 9/1968 | Larsen | 169/73 |
| 3,773,111 | 11/1973 | Dunn . | |
| 4,194,569 | 3/1980 | Heath | 169/26 |
| 4,393,941 | 7/1983 | Stevens | 169/70 |
| 4,700,894 | 10/1987 | Grzych | 169/70 |
| 4,779,683 | 10/1988 | Enk | 169/28 |

FOREIGN PATENT DOCUMENTS

| | | | |
|---|---|---|---|
| 803340 | 9/1936 | France . | |
| 893273 | 6/1944 | France | 169/26 |
| 2216178 | 10/1972 | Germany . | |
| 1245318 | 7/1986 | U.S.S.R. | 169/73 |
| 1470307 | 4/1989 | U.S.S.R. | 169/73 |
| 647867 | 12/1950 | United Kingdom | 169/26 |
| 893446 | 4/1962 | United Kingdom | 169/9 |
| 94/06515 | 3/1994 | WIPO . | |
| WO95/00205 | 1/1995 | WIPO . | |

*Primary Examiner*—Gary C. Hoge

*Attorney, Agent, or Firm*—Leydig, Voit & Mayer, Ltd.

[57] ABSTRACT

A nozzle unit for discharging and atomizing a fire or explosion suppressant comprises a rigid-walled cylindrical container having a nozzle portion at one end with radially directed discharge orifices. A rupturable barrier normally blocks the nozzle portion from the interior of the container. At the other end of the container, a piston is positioned so as to be sealingly slidable along the container in response to pressure generated by a gas pressure generator. The moving piston pressurizes the suppressant agent within the hollow interior until the rupturable barrier bursts. The suppresessant agent is accelerated substantially instantaneously and discharged in atomised form through the discharge orifices. The gas pressure generator may be a pyrotechnic gas generator. The arrangement is such that the pressurizing gas does not come into contact with the suppressant agent. However, if desired, some of the gas may be diverted into direct contact with the suppressant immediately before it is discharged, so as to heat and vaporize it. A plurality of the nozzle units may be connected together in a system to protect a specific area. The nozzle units may be connected individually by respective pipes to a common source of gas pressure instead of having their own individual gas generators.

30 Claims, 4 Drawing Sheets

DISCHARGING FIRE AND EXPLOSION SUPPRESSANTS

RELATED APPLICATION

This Application is a Continuation-in-part of application Ser. No. 08/278,411 filed Jul. 21, 1994, now abandoned.

BACKGROUND OF THE INVENTION

The invention relates to the discharging of fire and explosion suppressants.

BRIEF SUMMARY OF THE INVENTION

According to the invention, there is provided apparatus for discharging a fire or explosion suppressant, comprising a discharge nozzle, storing means for storing the suppressant juxtaposed with the nozzle, and discharge means for applying gas pressure to the stored suppressant without contact between the gas pressure and the suppressant, whereby to pressurise the suppressant and to cause it to discharge through the nozzle.

According to the invention, there is also provided apparatus for discharging a fire or explosion suppression agent, comprising a rigid-walled container having a hollow interior, nozzle means providing a discharge orifice mounted on the container, means within the hollow interior of the chamber defining an enclosure therein for receiving the suppressant agent, the means defining the enclosure including a rupturable barrier normally blocking the interior of the enclosure from the nozzle means and also including movable wall means within the hollow interior, and gas producing means for generating high gas pressure within a region of the interior of the container separated from the enclosure by the movable wall means, whereby the movable wall means moves in response to the gas pressure to compress the suppressant agent within the enclosure until the rupturable barrier ruptures and the suppressant agent is forcibly discharged through the nozzle means.

According to the invention, there is further provided apparatus for discharging a fire or explosion suppression agent, comprising a rigid-walled container having a hollow interior, nozzle means providing a discharge orifice mounted on the container, means within the hollow interior of the chamber defining an enclosure therein for receiving the suppressant agent, the means defining the enclosure including rupturable barrier means normally blocking the interior of the enclosure from the nozzle means and also including movable wall means within the hollow interior, gas producing means operative when activated to generate gas at high pressure and elevated temperature within the container, means feeding a first portion of the generated gas into a region of the interior of the container separated from the enclosure by the movable wall means, whereby the movable wall means moves in response to the gas pressure to compress the suppressant agent within the enclosure until the rupturable barrier means ruptures and the suppressant agent is forcibly discharged through the nozzle means in at least partially atomised form, and bypass means for receiving a second portion, only, of the generated gas and feeding it to between the rupturable barrier means and the nozzle means so as to heat the suppressant agent when the rupturable barrier means ruptures, thereby causing vaporisation of the discharged suppressant agent.

BRIEF DESCRIPTION OF THE DRAWINGS

Apparatus embodying the invention, and for discharging fire and explosion suppressant materials, will now be described, by way of example only, with reference to the accompanying diagrammatic drawings in which:

As shown in FIG. 1, the apparatus 4 comprises a cylindrical casing 5 made of suitable material to withstand the high pressures developed within it in use (as will be explained).

At one end of the chamber, a pressure generator 6 is mounted. The pressure generator may take any suitable form. Known forms of suitable pressure generator comprise pyrotechnic pressure generators of the azide type such as disclosed in United Kingdom Patent Specification No. 2174179. Alternatively, the pressure generator 6 could be of the explosive or cordite type. In either case, the pressure generator incorporates an igniter which, when electrically energised, causes the pressure generator to generate a high gas pressure very rapidly within the interior of the chamber 5.

Figure 1:
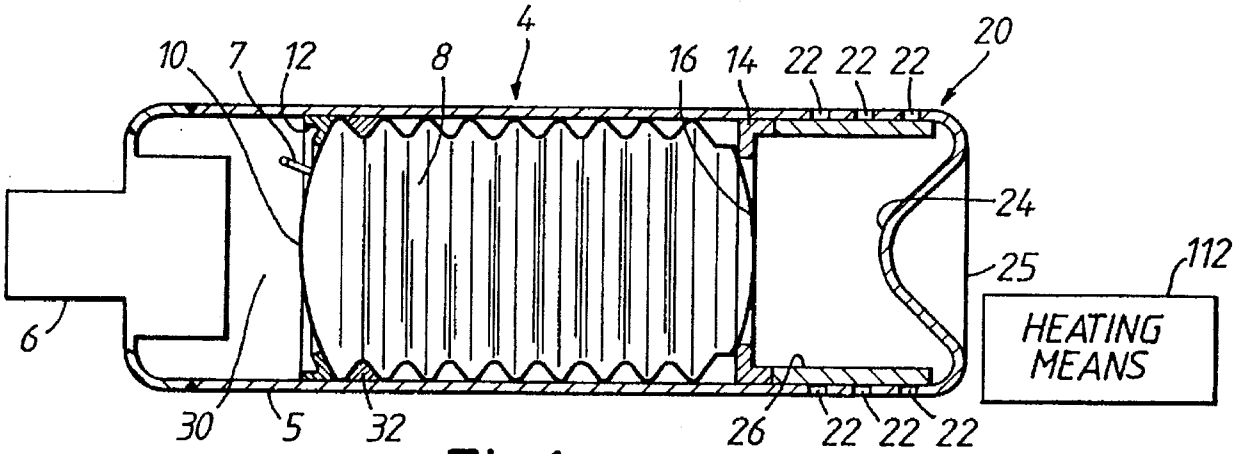
FIG. 1 is a longitudinal section through one form of the apparatus.

As shown in FIG. 1, the chamber 5 also incorporates a closed bellows arrangement 8 which is made of suitable flexible and resilient material so as to be a close fit within the interior of the chamber 5. The bellows arrangement 8 is closed using continuous welding techniques, thereby forming a hermetic suppressant container. An one of its ends, the bellows has an end face 10 which lies against an annular abutment 12 rigid with the interior wall of the chamber 5. A similar annular abutment 14 is fixed to the interior wall adjacent the other end face of the bellows which is constituted by a burst disc 16.

The interior space within the bellows 8 is charged with the extinguishant material. For example, this material may be an extinguishant sold by Great Lakes Chemical Corporation under the designation FM-200. However, any other suitable suppressant may be used, preferably one having zero ozone depletion potential (ODP) such as a suitable dry powder or water. The suppressant may be pumped into the interior of the bellows before the pressure generator 6 is placed in position, through a fill tube 7 connected to the interior of the bellows through an orifice in the end face 10 which is thereafter sealed. The pressure of the suppressant within the bellows 8 expands the bellows so that its end surfaces 10 and 16 are forced into contact with the abutments 12, 14.

At the end of the chamber 5 opposite to the pressure generator 6, an end portion 20 of the cylindrical wall of the chamber 5 is provided and provides a discharge nozzle. The nozzle is formed by apertures 22 in the end portion 20 and the axial end face 25 of the chamber is closed off by a conical deflector plate 24. Mounted around the interior face of the apertured end portion 20 is a cylindrical filter assembly 26 of the sintered-type.

In use, the suppressant within the bellows 8 is discharged by activating the pressure generator 6. When activated, the pressure generator 6 produces a very rapid build-up of pressure within the volume 30. The bellows becomes compressed, the end face 10 moving away from the abutment 12 and towards the abutment 14. An annular polytetrafluoroethylene seal or bore rider 32 prevents the gas pressure from entering the space between the wall of the chamber 5 and the bellows.

As the bellows becomes compressed, the pressure generated within the suppressant in the bellows increases very rapidly until the burst disc 16 of the bellows bursts. The extinguishant exits through the annular filter 26 and the apertures 22, being deflected radially outward by the conical deflector 24, the apertures 22 being provided around the complete circumferential surface of the end portion 20. Such radial discharge is free from discharge reaction forces.

The burst disc 16 of the bellows is arranged to be of suitable material so as to rupture at a predetermined pressure. The filter 26 acts as a screen causing the discharging suppressant to break up into droplets so as to enhance the atomization process. In addition, it acts as a debris screen to prevent discharge of fragments of the burst disc 16.

Effectively, the bellows acts as a piston, and substantially all of the suppressant will be expelled. The pressure generated by the pressure generator 6 may be arranged to rise very rapidly, at the order of 500 psi/mS (3.45 MPa/mS).

The burst disc 16 may be arranged to burst at, say, 1,200 psi (8.27 MPa). Substantially all of the extinguishant may be discharged within less than 70 milliseconds and effective atomisation is achieved.

Figure 4:
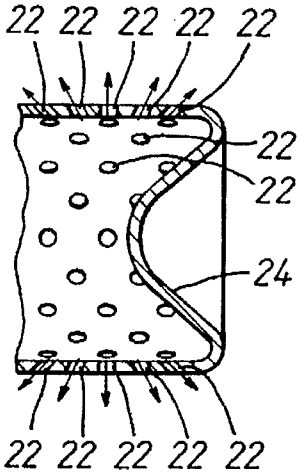
FIG. 4 is a longitudinal section of part of the apparatus of FIGS. 2 and 3 to an enlarged scale.

As shown in FIG. 4, which illustrates the end portion 20 but with the filter 26 removed, the holes 22 are shaped so as to direct the discharging suppressant not merely radially but also in directions inclined forwardly and rearwardly of the radial direction. In other words, the suppressant is discharged substantially omni-directionally. Again, the discharge reaction forces substantially cancel.

Figure 2:
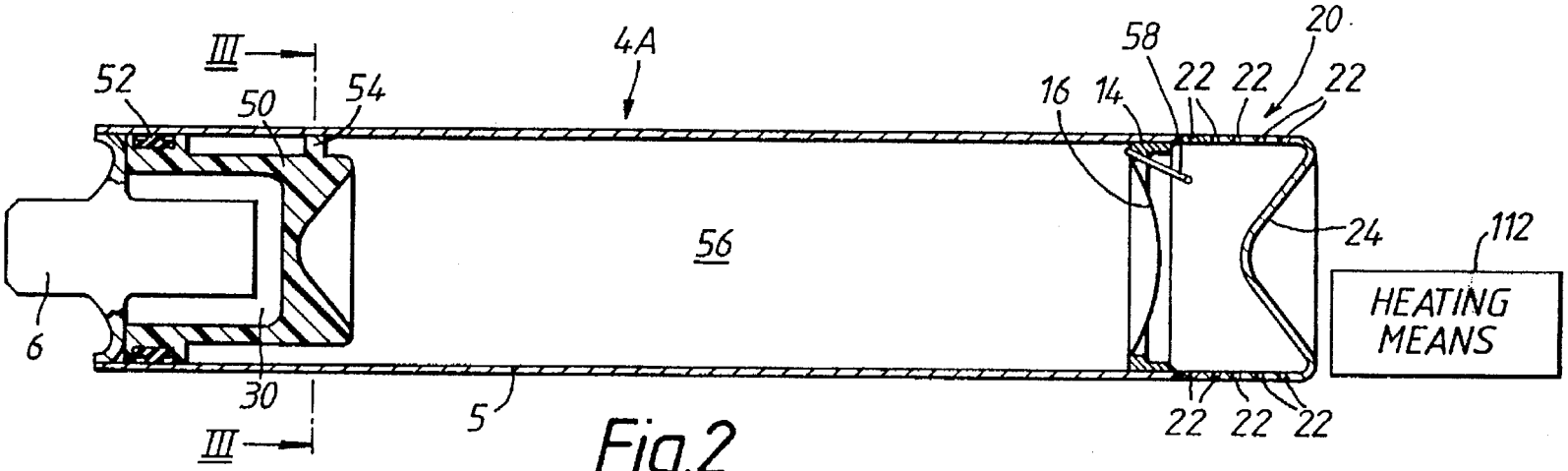
FIG. 2 is a longitudinal section through another form of the apparatus.

FIG. 2 shows a modified design 4A in which items corresponding to those in FIG. 1 are similarly referenced. In the design of FIG. 2, the gas generator 6 forms one end of the enclosure. The gas generator is hermetic in design and is welded to the chamber 5 using a continuous welding technique in order to form a hermetic suppressant container.

There is no bellows 8 and the burst disc 16 is fixed by continuous welding to the annular abutment 14. The abutment 14 is fixed to the chamber 5 by continuous welding.

Instead of the bellows 8 of FIG. 1, the apparatus 4A of FIG. 2 incorporates a piston 50 advantageously made of moulded material and incorporating a sliding annular seal 52 and three projections 54 which act as bore riders.

The suppressant material is forced into the interior volume 56 through a fill tube 58 which is thereafter sealed. The pressure within the volume 56 forces the piston 50 into the position shown in FIG. 2.

As before, ignition of the gas generator 6 generates a pressure which rises very rapidly within the volume 30 and moves the piston 50 to the right. (as viewed in the Figure), thus compressing the suppressant within the volume 56 until the discharge disc 16 bursts. As the discharge approaches completion, the nose of the piston 50 passes through the abutment 14 causing the projections 54 to shear. The nose of the piston 50 enters the nozzle 24 such as to cause substantially complete expulsion of the suppressant.

The suppressant becomes atomised by the high pressure and exits through the discharge orifices 22.

The apparatus shown in FIG. 2 does not have the filter 26 of FIG. 1 but this may be provided if required.

Atomisation of the discharged suppressant agent is achieved, in both forms of the apparatus described, by the kinetic effects of the very high velocity with which the suppressant is discharged. This high velocity is obtained by the use of a high discharge superpressure. Because of the presence of the piston in both forms of the apparatus described, which causes the suppressant agent to be rapidly pressurised until the burst disc ruptures, the discharged suppressant accelerates extremely rapidly, almost instantaneously, to its discharge velocity, thus optimising atomisation. If the developing gas pressure were to be applied directly to the suppressant agent, acceleration of the suppressant would be much slower. Atomisation is also assisted by the fact that the suppressant is stored immediately adjacent to the discharge orifices. The apparatus described may be used to discharge the extinguishants disclosed in, and to implement the procedures disclosed in, co-pending published European patent specification No. 0562756.

In both forms of the apparatus, there is no contact between the suppressant and the high pressure gas. This is advantageous when certain types of pressure generators are used which can produce toxic or potentially corrosive substances within the gas. This is particularly so with cordite-type gas generators. This makes the apparatus described especially suitable for applications, such as aircraft applications, where the presence of such toxic or potentially corrosive substances within the discharged suppressant is unacceptable.

Because the suppressant is pushed out by a piston or similar means, the discharge of the suppressant is independent of attitude (except to the marginal extent where acceleration forces on the piston will have an effect).

Figure 3:
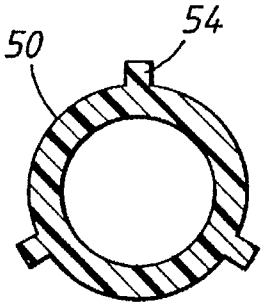
FIG. 3 is a cross-section on the line III—III of FIG. 2.
Figure 5:
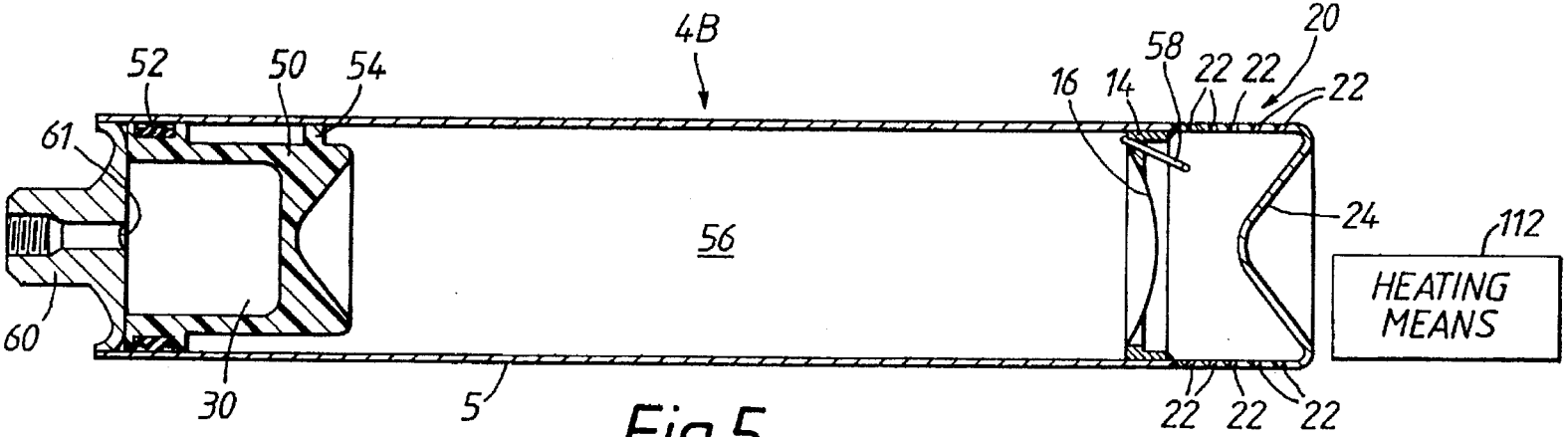
FIG. 5 is a longitudinal section through a modified form of the apparatus of FIGS. 2 and 3.
Figure 6:
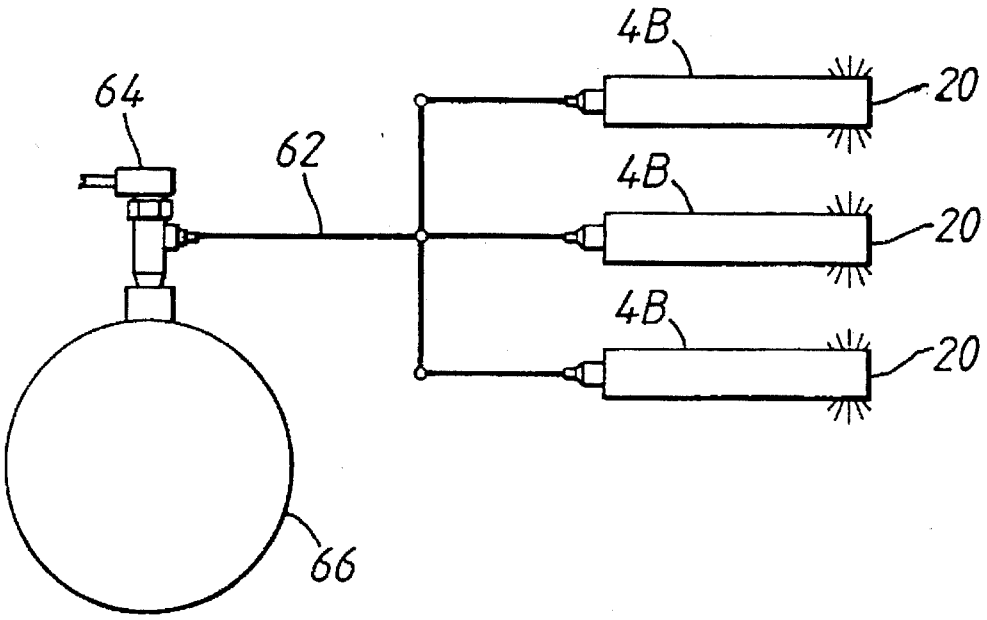
FIGS. 6 and 7 are schematic views of two systems incorporating the apparatus of FIG. 5.

The whole apparatus 4 or 4A can effectively be regarded as a nozzle "unit" which contains the suppressant. Thus, multiple units 4,4A could be deployed in a large or cluttered environment, each such unit being independent in the sense that it contains its own gas generator. Such multiple units could be connected to a central control unit by individual electrical connections (for activating the individual gas generators) to form a system. However, in very high temperature environments such as aircraft engine nacelles, a pyrotechnic gas generator may not have adequate thermal stability and this may lead to degradation of its operating characteristics. In order to overcome this problem, a modified form of the nozzle unit of FIGS. 2 and 3 may be used as shown in FIG. 5. In the nozzle unit 4B of FIG. 5, items corresponding to items in FIGS. 2 and 3 are similarly referenced. As shown in FIG. 5, the nozzle unit 4B does not use a gas generator. Instead, it has a gas coupling 60 for hermetic connection to a pipeline connecting it to a separate gas source. The separate gas source may be a gas generator or a source of stored gas. A seal disc 61 seals off the inner end of the pipe coupling 60. The interior 56 is, as before, filled with the suppressant. In use, the pressurised gas breaks the seal disc 61 and propels the piston 50 to the right to discharge the suppressant in the manner previously described. As shown in FIG. 6, a plurality of nozzle units 4B are mounted in an area to be protected and are connected, via their couplings 60 and pipelines 62, to a solenoid or cartridge activated valve 64 and thence to a gas storage bottle 66. When suppression is to take place, the valve 64 is opened (automatically, for example) and the gas stored under pressure in the bottle 66 is fed via the pipelines 62 to all the nozzle units 4B and operates them in the manner described.

FIG. 7 shows a system again employing nozzle units 4B but in which the pipelines 62 are connected to the output 68 of a gas generator 70. When suppression is to take place, the gas generator 70 is activated (automatically, for example) to generate gas pyrotechnically and the gas is again fed via the pipelines 62 to all the nozzle units 4B and activates them as described.

Figure 7:
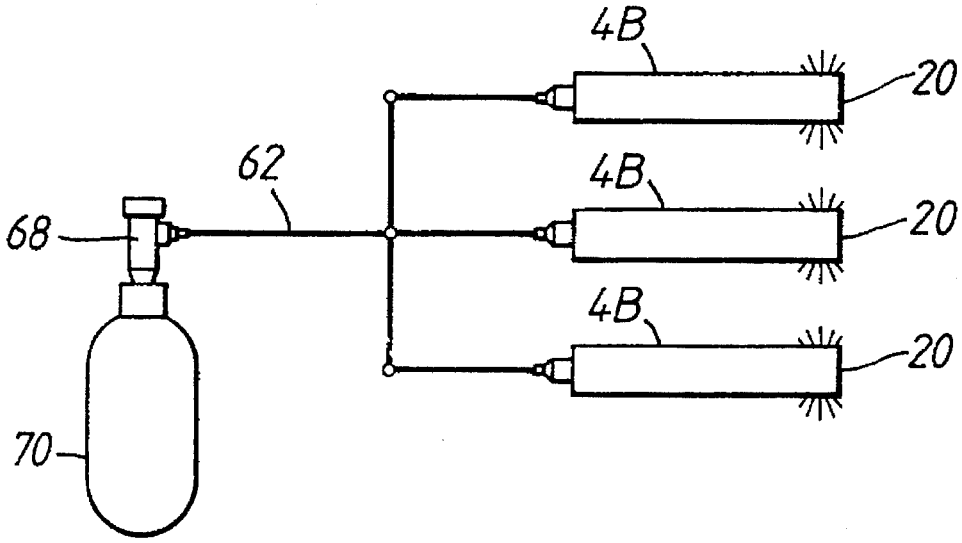

The arrangements shown in FIGS. 6 and 7 do not involve pipeline suppressant loss which occurs in known systems in which a plurality of extinguishant discharge heads are fed under pressure from a centralised supply of suppressant. In the nozzle units 4B, the suppressant is stored in respective sealed quantities in the units themselves.

A nozzle unit 4B of the form shown in FIG. 5 can if desired be used singly, and connected to a supply of stored pressurized gas or to a gas generator.

In all the embodiments described, there is none of the high pressure gas within the discharged suppressant agent. Therefore, the density of the discharging stream of suppressant agent is not reduced by the presence of any gas other than the vapour of the suppressant agent itself. This allows the diameters of the discharge orifices to be smaller for a given mass flow rate, which enhances the atomisation effectiveness.

Figure 8:
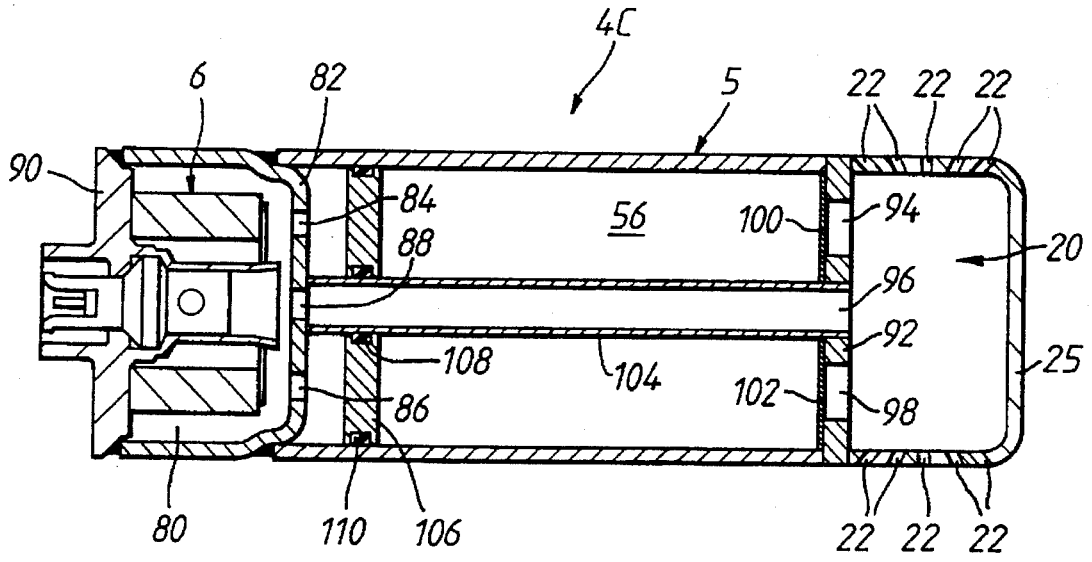
FIG. 8 is a longitudinal section through a further form of the apparatus.

FIG. 8 shows another form of the apparatus 4C in which parts corresponding to those in the other Figures are correspondingly referenced.

In the apparatus of FIG. 8, the pressure generator 6, which again may be a pyrotechnic pressure generator of the type described above, is mounted within a sub-chamber 80 which is divided from the remainder of the interior of the casing 5 by a wall 82. The wall 82 is apertured at 84, 86 and 88. An end wall 90 closes off the adjacent end of the casing 5.

At the end of the casing 5 opposite to the pressure generator 6, an end portion 20 is provided, which is generally similar to the end portion 20 in the other Figures. It is closed off by an end wall 25 and defines apertures 22 in the adjacent side wall of the casing. A dividing wall 92 closes off the end portion 20 from the interior 56 of the casing 5. The wall 92 is provided with apertures 94, 96 and 98. Apertures 94 and 98 are closed off from the interior 56 of the casing 5 by rupturable discs 100 and 102.

A solid tube 104 extends through the interior 56 of the casing 5, from the wall 82 to the wall 92, this tube thus connecting the aperture 88 with the aperture 96.

The apparatus of FIG. 8 is provided with a piston 106 which corresponds generally to the piston 50 of FIG. 2. However, the piston 106 slides on the outside of the tube 104 and is sealed to it by a sealing ring 108. The periphery of the piston 106 is sealed to the interior wall of the casing 5 by a seal 110.

The interior 56 is filled with suppressant material as before; this filling process may take place through a suitable fill tube (not shown). The pressure within the interior 56 forces the piston 106 to the left as shown in FIG. 8.

In use, and as before, ignition of the gas generator 6 generates hot gas, producing a very rapid pressure increase within chamber 80. The gas pressure is exerted on the left hand face (as viewed in FIG. 8) of piston 106 through apertures 84 and 86, thus moving the piston 106 to the right. The suppressant is therefore compressed within the volume 56 until the rupturable discs 100 and 102 burst. The compressed suppressant is thus rapidly ejected through the apertures 94 and 98 and then through the discharge apertures 22.

As before, atomisation of the discharged suppressant agent takes place, being produced by the kinetic effect of the very high velocity with which the suppressant is discharged.

In addition, though, in the apparatus of FIG. 8 some of the hot gas generated by the gas generator 6 is fed directly into the end portion 20 via the tube 104 and the apertures 88 and 96. The hot gas raises the sensible heat of the suppressant agent upon discharge in order to obtain vaporisation of the agent. The rate of direct gas supply through the tube 104 is controlled to the minimum rate necessary to ensure complete vaporisation of the suppressant agent when it is discharged at the lowest expected environmental temperature. The discharge from the nozzle will still be in the form of liquid droplets due to the pressure in the nozzle. The combined effects of atomisation and the sensible heat will result in flash vaporisation of the droplets close to the outside of the apertures 22. The suppressant agent is thus first atomised and then vaporised. Vaporisation of the discharging suppressant agent is found to be advantageous because it helps to achieve three dimensional dispersion in a cluttered environment, and thus helps to ensure that the suppressant has access to events which may not be in "line of sight" with the discharging nozzle.

The process of first atomising the suppressant and then vaporising it minimises the amount of heat which is required to obtain flash vaporisation. A significant consequence of this is that the temperature of the vaporised suppressant agent is minimised, thereby preserving the maximum heat abstraction potential per unit mass of the suppressant agent. Heat abstraction is a primary extinguishing mechanism of suitable suppressant agents.

The arrangement illustrated in FIG. 8 is advantageous because the amount of gas diverted to the end portion 20 (via tube 104) may be predetermined in order to obtain the desired vaporisation of the suppressant but not to overheat the suppressant.

The apparatus of FIG. 8 may be modified so that the end portion 20 incorporates a filter corresponding to the filter 26 of FIG. 1. It may also incorporate a conical deflector plate 24.

In a further modification, the heat to be applied to the pressurized suppressant, prior to its discharge, can be applied from another source, that is, not from the pyrotechnic gas generator. In such a case, the apparatus may take the form shown in FIG. 1, 2 or 5, with heat being applied separately to the end portion 20 as shown at 112.

The use of a gas generator is advantageous, as compared with the use of a stored supply of gas under pressure, in that the superpressure produced by the gas generator is substantially unaffected by temperature; with gas stored under pressure, this is not the case. In addition, the chamber 5 of the apparatus described does not have to meet the pressure fatigue requirements of a normal high pressure storage vessel (which must withstand repeated variations in pressure due to thermal cycles). The chamber 5 of the apparatus described simply has to be able to withstand the superpressure produced by the gas when suppression is to take place, and clearly this only has to be withstood for a relatively short time; the vapour pressure of the suppressant agent itself is very much lower than this superpressure. Therefore, very high levels of superpressure can be used, without the penalty of increasing container weight. Leakage of stored high pressure gas from the nozzle unit is also avoided.

Because the suppressant agent is stored on its own and without any pressurising gas, the status of the suppressant can be determined by a simple weight check.

What is claimed is:

1. Apparatus for discharging a fire or explosion suppressant, comprising a discharge nozzle, storing means for storing the suppressant juxtaposed with the nozzle, discharge means for applying gas pressure to the stored suppressant without contact between the gas pressure and the suppressant, whereby to pressurise the suppressant and to cause it to discharge through the nozzle, and heating means operative to apply heat to the pressurised suppressant, whereby to cause at least partial vaporisation of the discharged suppressant.

2. Apparatus according to claim 1, including a rupturable barrier for blocking the suppressant from the nozzle, the rupturable barrier being arranged to rupture when subjected to at least a predetermined pressure.

3. Apparatus according to claim 1, in which the storing means comprises an enclosure for receiving the suppressant agent, the enclosure being partly defined by movable wall means and including means for connecting the interior of the enclosure to the nozzle, and means applying the gas pressure to the movable wall means from outside the enclosure to move the movable wall means in a direction to force the suppressant through the nozzle.

4. Apparatus according to claim 3, in which the means for connecting the interior of the enclosure to the nozzle comprises a barrier arranged to rupture when subjected to at least a predetermined pressure.

5. Apparatus according to claim 3, comprising a rigid-walled container having a hollow interior, and in which the said enclosure is defined by a closed flexible bellows mounted in the interior of the container, a portion of the outside of the bellows constituting the movable wall means, the discharge means comprising means applying gas pressure to the said portion of the outside of the bellows and within the hollow interior so as to compress the bellows, the bellows incorporating a wall portion which constitutes the means for connecting the interior of the enclosure to the nozzle and is arranged to rupture under the pressure developed in the bellows to allow the suppressant to discharge through the nozzle.

6. Apparatus according to claim 3, comprising a rigid-walled container having a hollow interior and piston means which is sealingly slidable within the hollow interior and which forms the movable wall means, the said enclosure being defined between one face of the piston means and a rupturable barrier which is positioned within the container and which constitutes the means for connecting the interior of the enclosure to the nozzle, the discharge means applying the gas pressure to the other face of the piston means so that the piston means moves to compress the suppressant agent within the enclosure until the rupturable barrier ruptures whereby the suppressant agent is discharged through the nozzle.

7. Apparatus according to claim 3, in which the discharge nozzle comprises means defining a plurality of discharge holes connecting the interior of the enclosure to its exterior, the holes being shaped so that together they direct the discharged suppressant substantially omni-directionally.

8. Apparatus according to claim 3, in which the movable wall means is forced to move through a predetermined extent of travel sufficient to discharge substantially all of the suppressant from the enclosure.

9. Apparatus according to claim 4, including screening means for the discharge of fragments of the rupturable barrier.

10. Apparatus according to claim 1, in which the discharge means comprises gas generating means mounted on the storing means.

11. Apparatus according to claim 10, in which the gas generating means comprises pyrotechnic gas generating means.

12. Apparatus according to claim 1, in which the discharge means comprises a source of the gas pressure connected to the storing means by a pipe.

13. Apparatus according to claim 12, in which the source of the gas pressure is gas generating means.

14. Apparatus according to claim 12, in which the source of the gas pressure is a container containing gas under pressure.

15. A plurality of separate apparatuses each according to claim 12, the said source being connected to the storing means of each of them by a respective said pipe.

16. Apparatus according to claim 1, in which the discharge nozzle is arranged to discharge the suppressant substantially omni-directionally such that discharge reaction forces substantially cancel.

17. Apparatus for discharging a fire or explosion suppressant, comprising a discharge nozzle, storing means for storing the suppressant juxtaposed with the nozzle, discharge means for applying gas pressure to the stored suppressant without contact between the gas pressure and the suppressant, whereby to pressurise the suppressant and to cause it to discharge through the nozzle, and heating means for applying heat to the pressurised gas suppressant, whereby to cause at least partial vaporisation of the discharged suppressant, the discharge means comprising pyrotechnic gas generating means for generating high temperature gas under pressure, the heating means comprising bypass means for receiving part, only, of the high temperature gas and feeding it into contact with the pressurised suppressant.

18. Apparatus according to claim 17, in which the storing means comprises an enclosure for receiving the suppressant agent, the enclosure being partly defined by movable wall means and including means for connecting the interior of the enclosure to the nozzle, and means applying the gas pressure to the movable wall means from outside the enclosure to move the movable wall means in a direction to force the suppressant through the nozzle.

19. Apparatus according to claim 18, comprising a rigid-walled container having a hollow interior and piston means which is sealingly slidable within the hollow interior and which forms the movable wall means, said enclosure being defined between one face of the piston means and a rupturable barrier which is positioned within the container and which constitutes the means for connecting the interior of the enclosure to the nozzle, the discharge means applying the gas pressure to the other face of the piston means so that the piston means moves to compress the suppressant agent within the enclosure until the rupturable barrier ruptures whereby the suppressant agent is discharged through the nozzle.

20. Apparatus according to claim 19, in which the by-pass means comprises means defining an enclosed path having a first path end in communication with the pyrotechnic gas generating means for receiving the said part, only, of the high temperature gas and a second path end in communication with the storing means, the enclosed path passing sealingly through the piston means and the rupturable barrier.

21. Apparatus for discharging a fire or explosion suppressant agent, comprising a rigid-walled container having a hollow interior, nozzle means providing a discharge orifice mounted on the container, means within the hollow interior of the chamber defining an enclosure therein for receiving the suppressant agent, the means defining the enclosure including a rupturable barrier normally blocking the interior of the enclosure from the nozzle means and also including movable wall means within the hollow interior, gas producing means for generating high gas pressure within a region of the interior of the container separated from the enclosure by the movable wall means, whereby the movable wall means moves in response to the gas pressure to compress the suppressant agent within the enclosure until the rupturable barrier ruptures and the suppressant agent is forcibly discharged through the nozzle means, and heating means operative to apply heat to the compressed suppressant agent, whereby to cause at least partial vaporisation of the discharged suppressant agent.

22. Apparatus according to claim 21, in which the enclosure is defined by a flexible bellows having a hollow interior, part of the bellows comprising the rupturable barrier and another part thereof comprising the movable wall means.

23. Apparatus according to claim 21, in which the container has at least a portion of constant cross-section, and in which the rupturable barrier comprises a rupturable wall across the constant-cross section portion and the movable wall means comprises a piston slidable in response to the gas pressure towards the rupturable wall and along the portion of constant cross-section.

24. Apparatus for discharging a fire or explosion suppression agent, comprising a rigid-walled container having a hollow interior, nozzle means providing a discharge orifice mounted on the container, means within the hollow interior of the chamber defining an enclosure therein for receiving the suppressant agent, the means defining the enclosure including rupturable barrier means normally blocking the interior of the enclosure from the nozzle means and also including movable wall means within the hollow interior, gas producing means operative when activated to generate gas at high pressure and elevated temperature within the container, means feeding a first portion of the generated gas into a region of the interior of the container separated from the enclosure by the movable wall means, whereby the movable wall means moves in response to the gas pressure to compress the suppressant agent within the enclosure until the rupturable barrier means ruptures and the suppressant agent is forcibly discharged through the nozzle means in at least partially atomised form, and bypass means for receiving a second portion, only, of the generated gas and feeding it to between the rupturable barrier means and the nozzle means so as to heat the suppressant agent when the rupturable barrier means ruptures, thereby causing vaporisation of the discharged suppressant agent.

25. Apparatus according to claim 24, in which the enclosure comprises at least a portion of the interior of the container having constant cross-section and extending longitudinally within the hollow interior, the rupturable barrier means forming at least part of one longitudinal end of the portion of constant cross-section, the movable wall means comprising a piston sealingly slidable in response to the gas pressure towards the rupturable barrier means and along the portion of constant cross-section.

26. Apparatus according to claim 25, including fixed wall means positioned within the hollow interior between the gas producing means and the piston and on the opposite side of the piston to the rupturable barrier means, the fixed wall means being apertured to apply said first portion of the gas to the piston.

27. Apparatus according to claim 26, in which the bypass means comprises means defining an enclosed path through the enclosure and extending between a first path end in communication with the gas producing means and a second path end in communication with a region of the hollow interior between the rupturable barrier means and the nozzle means.

28. Apparatus according to claim 27, in which the means defining the enclosed path comprises a tube extending through the enclosure from an aperture in the fixed wall means to and through the rupturable barrier means.

29. Apparatus according to claim 28, in which the tube extends through the piston means and the piston means slides sealingly on the tube.

30. Apparatus according to claim 24, in which the gas producing means comprises pyrotechnic gas producing means.

* * * * *